United States Patent [19]

Stemmle

[11] Patent Number: 4,589,653

[45] Date of Patent: May 20, 1986

[54] CANTILEVERED SORTER

[75] Inventor: Denis J. Stemmle, Webster, N.Y.

[73] Assignee: Xerox Corporation, Stamford, Conn.

[21] Appl. No.: 718,614

[22] Filed: Apr. 1, 1985

[51] Int. Cl.[4] ..... B65H 31/24; B65H 39/11

[52] U.S. Cl. ..... 271/293; 271/294

[58] Field of Search ..... 271/293, 294, 292

[56] References Cited

U.S. PATENT DOCUMENTS

| | | | |
|---|---|---|---|
| 3,721,435 | 3/1973 | Zanders | 271/64 |
| 3,868,019 | 2/1975 | Stemmle | 211/126 |
| 4,055,339 | 10/1977 | Looney | 271/173 |
| 4,162,787 | 7/1979 | Shirahase et al. | 271/173 |
| 4,328,963 | 5/1982 | DuBois et al. | 271/293 |
| 4,332,377 | 6/1982 | DuBois et al. | 271/293 |
| 4,343,463 | 8/1982 | Lawrence | 271/293 |
| 4,466,609 | 8/1984 | Lawrence | 271/293 |
| 4,478,406 | 10/1984 | DuBois | 271/293 |

*Primary Examiner*—Bruce H. Stoner, Jr.
*Assistant Examiner*—James E. Barlow

[57] ABSTRACT

Apparatus for sorting sheets wherein the individual bins in the sorter are supported in the frame member in cantilevered fashion about only one edge and are open and unsupported in any other position. Each bin has plural means to movably support the bin in the frame comprising at least two support members slidingly engagable with the frame and sufficiently vertically spaced apart to prevent equilibrium when a coefficient of friction between the support means and the frame is at least 0.3 and a friction force between the support means and the frame is less than the weight of the bin, and further including a C-cam to sequentially vertically move said bins in the frame past a sheet entrance position.

22 Claims, 4 Drawing Figures

CANTILEVERED SORTER

CROSS REFERENCE TO RELATED APPLICATION

Reference is hereby made to copending application Ser. No. 637,235, entitled Cantilevered Sorter, filed Aug. 2, 1984 in the name of Joseph R. Barone which is commonly assigned to the assignee of the present invention.

BACKGROUND OF THE INVENTION

The invention relates generally to sorting apparatus for collating sheets into sets and is particularly adapted for use, although not exclusively, with or as part of an electrophotographic printing machine.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated area. This records an electrostatic latent image on the photoconductive member corresponding to the informational areas contained within the original document being reproduced. After the electrostatic latent image is recorded on the photoconductive member, the latent image is developed by bringing a developer mixture into contact therewith. Generally, the developer mixture comprises toner particles adhering triboelectrically to carrier granules. The toner particles are attracted from the carrier granules to the latent image forming a toner powder image on the photoconductive member. The toner powder image is then transferred from the photoconductive member to a copy sheet. Finally, the copy sheet is heated to permanently affix the toner particles thereto in image configuration.

Frequently, it is highly desirable to reproduce a plurality of copies of the same original document. Moreover, if several original documents are reproduced, it is desirable to form a plurality of collated sets of copies. This may be achieved by the utilization of a sorting apparatus. Generally, the sorting apparatus comprises a plurality of bins or trays wherein each tray is designed to collect one set of copies of the original document. A variety of sorters are known in the art. One typical sorter employs tray members which are spaced apart and extend in a linear row. Another type of sorting apparatus has a tray member extending radially outwardly from an axis of rotation. These are the two basic types of sorters generally used commercially, i.e. a linear type and a rotary type.

Copy sheets may be collected in the trays of the sorter in a number of ways. The most common technique is to utilize a sheet transport to advance the copy sheets past the tray openings and deflection fingers to guide the sheets from the transport into the respective tray. Another technique comprises the use of a moving deflection finger which travels from tray to tray to deflect the copy sheet into the respective tray. Yet still another approach is to move the trays past the sheet ejecting portion of the transport. In this way, the trays collect successive sheets therein.

PRIOR ART

U.S. Pat. No. 4,055,339 to Looney describes a sorter having at least two arrays of bins supported on a rotatable turntable. Each bin array has a series of vertically oriented bins with an elevator for raising or lowering all the bins. The individual bins are supported about one edge of the bins and the array of bins moves vertically to position successive bins at an inlet station. Each bin opens to receive a copy sheet. After all the copy sheets are in their respective bins, the turntable rotates and the array of bins moves vertically to position successive bins at a discharge station, each bin opens and the copy sheets are unloaded therefrom.

U.S. Pat. No. 4,478,406 to DuBois et al. describes a sorter using drive cams having helical slots therein which engage trunnions extending from the trays, move the trays up or down as the cams rotate at the input end of the bins. The output end of the bins is supported by a support member 61.

U.S. Pat. No. 3,868,019 to Stemmle describes a sorter with nestable bins wherein the bins are driven up and down by means of three spiral cams.

SUMMARY OF THE INVENTION

In accordance with the principal aspect of the present invention, a sorting apparatus comprising a plurality of vertically nestable movable bins and a frame member for supporting said bins adjacent only one edge of said bins is provided. The bins are supported in the frame member in cantilevered fashion only about one edge and are open and unsupported at any other edge, each bin comprises a sheet stacking bed together with plural means to movably support the bin in the frame, the plural means comprising at least two support means slidingly engagable with said frame and sufficiently vertically spaced apart to prevent equilibrium when the coefficient of friction between the support means and the frame is at least 0.3 such that the friction force between the support means and the frame is less than the weight of the bin together with any copy sheets thereon, and further including means to sequentially vertically move said bins in said frame past the sheet entrance position.

In a further aspect of the present invention, the support means comprises substantially vertical legs attached to the sheet stacking bed of each bin and each leg having feet attached at the end slidingly engagable with the frame member.

In a further aspect of the present invention, the plural support means includes three substantially vertical legs attached to the sheet stacking bed of each bin with feet attached at the end and slidingly engagable with vertical slots in said frame member, at least one of said feed being below the sheet stacking bed and the remaining feet being above the sheet stacking bed.

In a further aspect of the present invention, the frame member is a vertical planar member such as sheet metal with vertical slots vertically slidingly engagable with the feet of the bin legs.

In a further aspect of the present invention, the sorter is provided with means to vertically bidirectionally move said bins past a sheet entrance position.

In a further aspect of the present invention, the lowermost bin in said plurality of bins is spring biased upwardly and the force from said spring bias is communicated through all bins located below said sheet entrance position such that the uppermost of said bins below said sheet entry position is forced into engagement with the peripheral surface of a rotatably mounted cam having at least one notch in the peripheral surface thereof adapted to engage the feet of successive bins.

In a further aspect of the present invention a printing system including the present sorter is provided.

BRIEF DESCRIPTION OF THE DRAWINGS

For a better understanding of the invention as well as other objects and further features thereof, reference is had to the following drawings and descriptions.

DESCRIPTION OF THE PREFERRED EMBODIMENT

Figure 1:
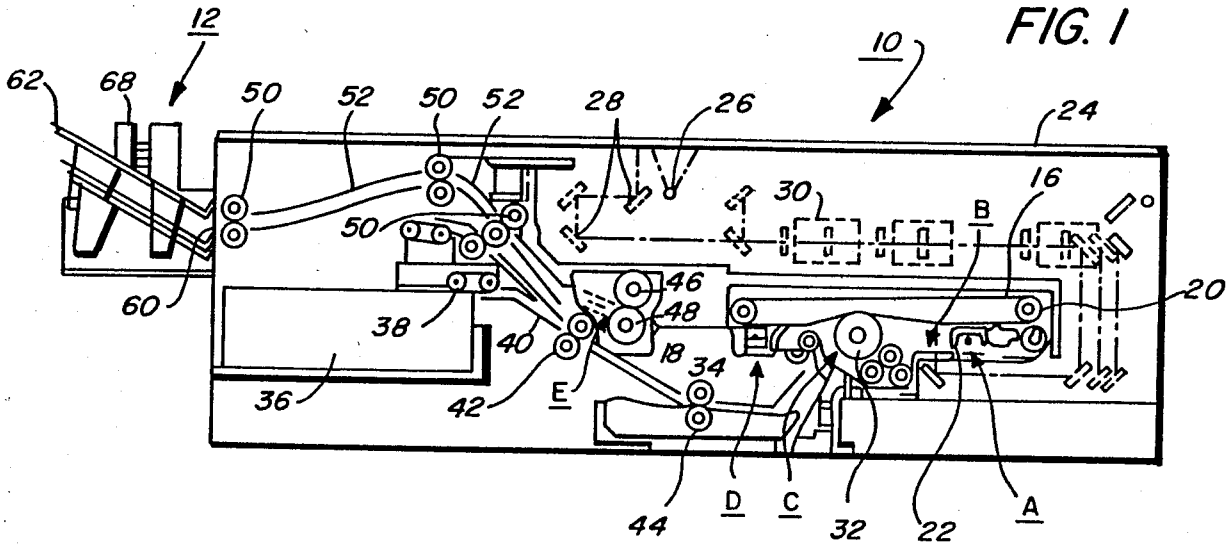
FIG. 1 is a schematic cross-section of a xerographic printing machine having a preferred embodiment of the sorting apparatus according to the present invention.

For a general understanding of the features of the present invention, reference is made to the attached drawings wherein like reference numerals have been used to identify identical elements.

Referring now to FIG. 1, there is shown an automatic xerographic reproducing machine having attached thereto a sheet sorter according to the invention for collecting copy sheets produced by the machine. Although the present invention is particularly suited for use in an automatic xerographic apparatus, it is equally well adapted for use with any number of devices in which cut sheets of material are delivered serially for collating into sets. Inasmuch as the art of electrophotographic printing is well known, the various processing stations employed in the reproducing machine illustrated in FIG. 1 will be shown schematically and their operation described briefly with reference thereto.

As shown in FIG. 1, the electrophotographic printing machine 10 is coupled to sorting apparatus 12. Printing machine 10 employs a belt 16 having a photoconductive surface deposited on a conductive substrate. Preferably, the photoconductive surface is made from a selenium alloy with the conductive substrate being made from an aluminum alloy. Other suitable photoconductive materials and conductive substrates may also be employed. Belt 16 is entrained about a pair of opposed spaced rollers 18 and 20. Roller 20 is rotated by a motor coupled thereto by suitable means, such as a drive belt. As roller 20 rotates, belt 16 advances the photoconductive surface through the various processing stations disposed about the path of movement thereof.

Initially, the photoconductive surface passes through charging station A. At charging station A, a corona generating device 22 charges the photoconductive surface to a relatively high substantially uniform potential.

Next, the charged portion of the photoconductive surface is advanced through imaging station B. At imaging station B, an original document is positioned face down upon a transparent platen 24. Imaging of a document on platen 24 is achieved by an exposure system which includes a lamp 26, mirrors 28 and a lens 30. The exposure system is a moving optical system wherein the lamps and mirrors, move across the original document illuminating incremental widths thereof. The lens may be moved to change magnification. In this way, an incremental width light image is formed. The light image is projected onto the charged portion of the photoconductive surface. The charged photoconductive surface is discharged selectively by the light image to record an electrostatic latent image of the original document thereon. Thereafter, belt 16 advances the electrostatic latent image recorded on the photoconductive surface to development station C.

With continued reference to FIG. 1, at development station C, a magnetic brush developer roller 32 advances developer material into contact with the electrostatic latent image. The latent image attracts toner particles from the carrier granules of the developer material to form a toner powder image on the photoconductive surface of belt 16.

Belt 16 then advances the toner powder image to transfer station D. Successive copy sheets are advanced from stack 36 by sheet feeder 38. Sheet feeder 38 advances the uppermost sheet from stack 36 into chute 40. Forwarding rollers 42 and 44 continue to advance the sheet to transfer station D. At transfer station D, a corona generator 34 sprays ions onto the back side of the copy sheet positioned thereat. This attracts the toner powder image from the photoconductive surface of belt 16 to the sheet. After transfer of the toner powder image to the copy sheet, the copy sheet advances through fusing station E.

Fusing station E includes a heated fuser roller 46 and a back-up roller 48 with the toner particle image on the sheet contacting fuser roller 46. In this manner, the powder image is permanently affixed to the copy sheet.

After fusing, the copy sheets are advanced by forwarding rollers 50 through chutes 52 to the copy sheet outlet region. Sorter 12 is located adjacent the copy sheet outlet region to receive the copy sheets at the sorter inlet end 60. Bins 62 on opposed sides of copy sheet inlet region 60 are closely spaced to one another. The bins located on either side of inlet region 60 are shifted relative to one another to provide a wide entry region. Sorter bins 62 are supported movably and shiftably relative to one another on rear side edge thereof on sorter frame 68. The inlet end and the outlet end of sorter bins 62 are unsupported. Thus, the trays are cantilevered with the inlet end, and the outlet end, the front side edge of each bin being unsupported.

Figure 2:
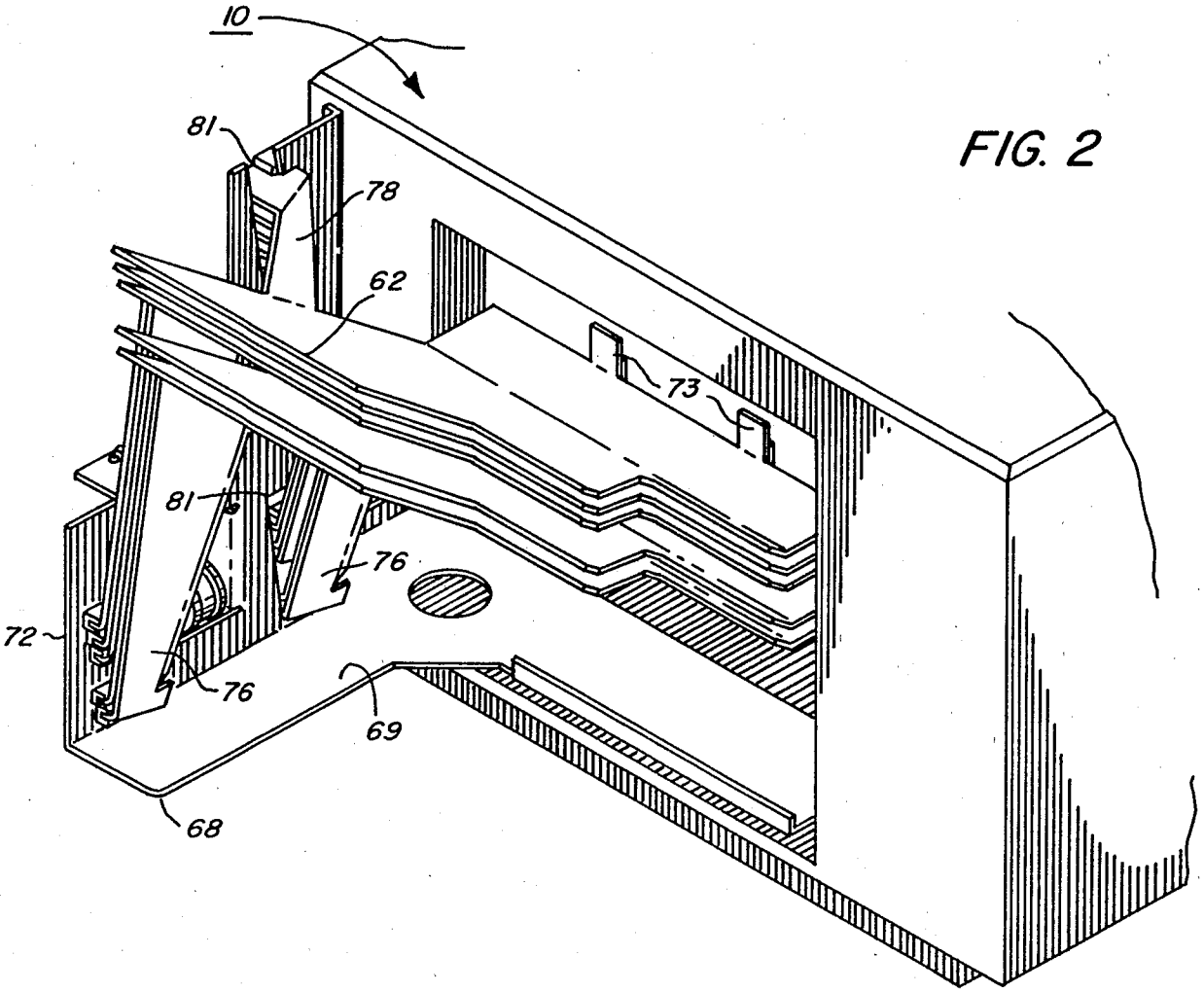
FIG. 2 is an isometric view from the front of the cantilevered sorter according to the present invention.
Figure 3:
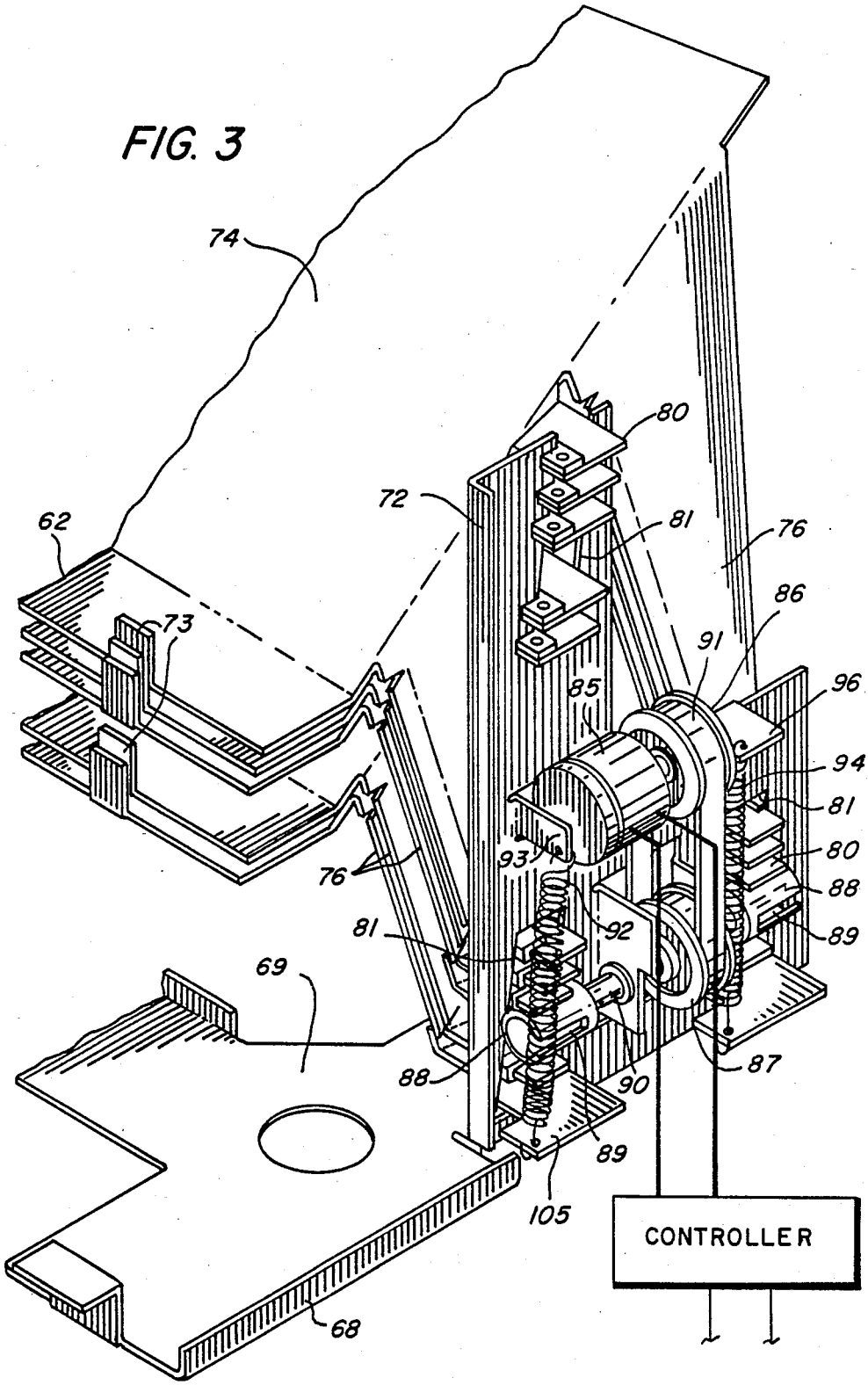
FIG. 3 is an isometric view from the rear of the sorter showing greater detail of the bin support and indexing mechanism.

Referring now to FIGS. 2 and 3, wherein the sorter is exhibited in greater detail, a plurality of vertical bins 62 is arranged in a vertically nestable array each of the bins being oriented for the uphill stacking of individual sheets as they are inserted in the bins and having at the input end of each of the bins sheet stop member 73. The bins are arranged in a vertical array supported on a frame 68 having a bottom support portion 69 and a vertical support portion 72. Typically the frame may be made from a single piece of sheet metal having placed in its bottom support portion 69 suitable means by which to fasten it to the output end of a copying apparatus such that the input end of the bin is arranged adjacent to the output or exit rolls of the reproducing apparatus. Each of the bins 62, which may also be made from sheet metal or molded plastic, comprise a bed portion 74 together with a plurality of legs 76 and 78 each having attached at its end a foot portion 80 which is insertable in vertical slots 81 in the vertical frame member 72. The bin feet 80 frictionally engage and slide relative to portions of the frame member adjacent to slots 81. The legs of the individual bins are inclined at a small angle from vertical to enable them to nest one on the other.

The bins are indexed vertically in a bidirectional fashion by reversable motor 85 which drives two C-cams 88 mounted on shaft 90 through means of pulleys 86 and 87 and belt 91. Each of the C-cams comprises a rotatably mounted cam having at least one notch 89 in the peripheral surface thereof adapted to engage the feet 80 of the successive bins to move them from one side of the sheet entrance position to the other side of the sheet entrance position. The bottommost feet of the bottommost tray 105 are biased upwardly by means of springs 92 and 94 anchored to tabs 93 and 96 at the back of the vertical support frame 72. This upward bias is communicated through all bins located below the C-cam such that tabs 80 on the uppermost bin below the C-cam are biased against the lower peripheral surface of the C-cams. In addition, the bottommost feet or indexing tabs 105 are of unique design being sufficiently long such that when the C-cam rotates in contact therewith, they are not engaged by the C-cam and indexed to the top of the C-cam but rather remain below the sheet entrance position.

The operation of the sorter is very simple. The bins are initially spaced close to one another leaving only enough room between bins to contain the maximum anticipated set size, for example, 25 sheets. The bins are initially spaced below the indexing means and the actuation of the bins is controlled through a controller as illustrated in FIG. 3 connected to the copier. For example, with all the bins below the indexing means and the top bin at the sheet entrance position a sensor in the copier may detect the trail edge of the first sheet entering the top bin after which the controller turns the motor on for one revolution of the C-cam. This lifts the top bin to a position above the sheet entrance position leaving a wide gap between the top bin and the second from the top bin at the sheet entrance position to allow the second sheet to be inserted into the second bin without interference. After the second sheet is loaded, the C-cams rotate one more revolution to lift the second tray above the sheet entrance position. The second tray lifts the first one slightly higher by the same narrow gap distance as in the lower positions. Spacers on the bin feet may be used to determine the size of the narrow gap. The outer diameter of the C-cam provides the wider gap at the sheet entrance position. The lower feet on all of the bins located below the bin indexing C-cam are biased upward against the lower surface of the C-cam by the springs 92 and 94. In the upper position, the bins are biased downwardly against the upper surface of the C-cam by gravity and the bins may now be indexed in the reverse direction by rotating the C-cam in the opposite direction.

In order to function properly, the bins together with any sheets sorted in the individual bins should slide vertically down in the vertical frame member by virtue of their own weight. FIGS. 2 and 3 illustrate the use of three legs with associated feet or indexing tabs about which bins are movable upward vertically by means of the indexing apparatus and can slide down freely by virtue of their own weight. Furthermore the three supports gives the stability in the structure against rotational and translational movement while providing the necessary support for the vertical movement up and down. Alternatively four or more legs together with indexing tabs could be used but this increases the frictional forces and creates difficulties with regard to manufacturing and operational tolerances. In particular, more than three legs increases the probability of binding because of the close tolerances in the four or more legs and arms. Furthermore, two of the legs should be spread across the width of the rear portion of the bins to enable the center of gravity of the bins to fall within the boundary of at least two legs and thereby inhibit any rotational movement.

Figure 4:
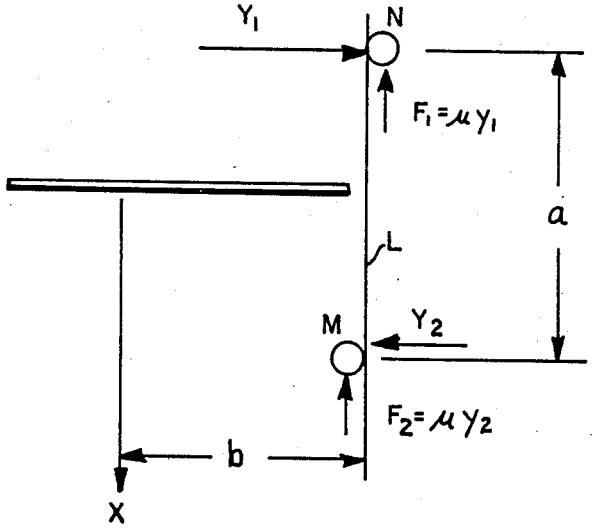
FIG. 4 is a graphical representation of the forces and moment considerations involved in the design of the sorter according to the present invention.

Referring to FIG. 4, the basic principal upon which the present invention is based, is simply described in terms of the moments and forces acting on the bins in the vertical array. Points M and N are indicated to be respectively the bottom and top feet of an individual bin in relationship to the vertical frame member L. Summing the moments about point M, the weight X of the tray together with the weight of any sheets stacked thereon times it moment arm b is equal to some force $Y_1$ exerted on the top indexing tab times its moment arm a or $$bX = aY_1 \text{ or } Y_1 = bX/a.$$

To counteract a given moment bX it can readily been seen that for small values of "a" the normal force $Y_1$ is very high. Thus if b is say 10 inches and "a" is only small, about 1 inch, then the normal force $Y_1$ equals ten times the weight X of the tray.

The principle vertical forces on the individual bins include X the weight of the bin together with the weight of any sheets thereon and a vertical frictional force $F_1$ and $F_2$ at each of the points M and N $F_1 = \mu Y_1$ at Point N, $\mu$ = coefficient of friction.

$F_2 = \mu Y_2$ at point M but $Y_2 = Y_1$ (summation of all horizontal forces)

therefore $X$ (downward vertical force) $= 2\mu Y_1$ (the upward vertical force at equilibrium)

from above $$Y_1 = bX/a$$

therefore $$X - 2\mu(bX/a) = 0$$

at equilibrium, or

Now if b is equal to 10 inches and a is equal to 1 inch, then the system will remain in equilibrium and thus the trays will not slide relative to the frame unless $\mu$ is 0.05 or less.

However for sliding friction arrangements, this is a very low value for the coefficient of friction achievable only with the most exotic bearings. It is achievable for example, with the use of needle bearings which are extremely expensive, making their use in simple low cost devices and applications impractical. It is best to design the system which enables the trays to slide freely relative to the frame when the coefficient of friction is at least 0.3 and as a practical matter to design them for use with coefficients around 0.4, 0.5 to insure against wear and/or contamination during use. Going back to our formula:

$$2\mu(b/a) = 1$$

if b is 10 and a is 8, then $$\mu = 0.40$$

Thus by spacing the vertical support feet apart, one is able to design a system wherein reasonable coefficients of friction can be tolerated and still enable individual bins to free fall without inducing stick slip type of chatter as the bins move up and down.

Accordingly, by spacing at least two of the support feet which are slidingly engagable with the frames sufficient vertically apart to permit the coefficient of friction between the support frame and the feet at equilibrium to be at least 0.3 the friction force between the support means will be less than the weight of the bins and a practical inexpensive cantilevered sorter can be provided.

This is an improvement over the device illustrated in the above referenced copending Barone application wherein the roller pair about which each sorter bin is mounted on the sorter frame has one roller on each side of the frame vertically displaced from each other by a very small distance. As a result, the normal forces of the rollers against the sorter frame are very high. This is because the moment of the tray about the roller on the inside of the sorter frame which comprises the weight of the tray together with any sheet stack therein multiplied by the relatively long moment arm from the roller on the inside of the frame to the center of gravity of the bin is very large. At equilibrium the moment of the roller on the outside of the sorter frame about the roller on the inside of the sorter frame is equal to this moment and since the moment arm is relatively short, the force must be very large. As previously pointed out with such a large normal force, the device could operate only with sophisticated low frictional bearing elements which are very costly particularly when several have to be used for each bin.

Thus according to the present invention, a very simple inexpensive sorter permitting unencumbered access to the input end, the output end and to the front is provided. The drives and the frames are relatively simple and the unencumbered access means that sorter convers and other parts do not have to be opened up for jam clearance. By spreading the cantilevered support mechanism apart vertically, the frictional force is substantially reduced so that a reasonable high and practical coefficient of sliding friction can be tolerated. Furthermore, with this principle the individual bins may be the same size and shape enabling them to nest together. The sorter provides a cantilevered stacking of identical bins which is based on a sliding friction concept instead of upon the use of elaborate and costly bearings and at the same time, avoids the chatter stick slip of bin binding in the frame member.

In addition by designing the sorter so the bins can slide at a high coefficient of friction not only are the costly bearings eliminated but also rollers, pins and fasteners together with assembly labor costs associated with each bin eliminated. In addition, the sorter according to the present invention has all the advantages of a moving bin sorter with a wide open area for loading and a narrow space in between individual bins for stacking. Furthermore, the device utilizes a relatively simple indexing mechanism and drive system.

All the patent applications and patents referred to herein are hereby specifically incorporated by reference in their entirety into the instant specification.

While a specific embodiment of the present invention has been described above it will be understood that various modifications may be made to the specific details referred to herein without departing from the scope of the invention as defined in the appended claims. For example, while the sorter device has been illustrated as an uphill sorter, the principal is equally well applied to downhill stacking of sheets in individual trays. Furthermore while the device has been illustrated with regard to the use of two C-cams, one on either side to index the individual bins up and down, it will be appreciated that the indexing mechanism may be provided with only one C-cam or a Geneva mechanism or disk/slot type of mechanism. Furthermore while the device has been illustrated with two support feet at the bottom of each of the individual bins with one support foot at the top of the bins, it will be appreciated that two could be at the top and one could be at the bottom as long as the principal of separating the support feet remains the same. In this connection it should be noted that the support legs can both be above or below the bin bed as long as the vertical spacing between them is sufficiently large. It should be noted that rather than the feet sliding in contact with the flat surface of a sheet metal frame, the slidable surface of the frame could be a bar, tube, or a variety of other shapes. It is intended that such alternatives and modifications and others as may be readily apparent to the artisan may come within the scope of the appended claims.

What is claimed is:

1. A sorter comprising a plurality of vertically nestable moveable bins, a frame member for supporting said bins adjacent only one edge of said bins, said bins being supported in said frame in cantilevered fashion only about one edge and being open and unsupported at any other edge;

each bin comprising a sheet stacking bed together with plural means to movably support and frictionally slide the bin in said frame, said plural means comprising at least two support means slidingly engagable with said frame and sufficiently vertically spaced apart to prevent static equilibrium of vertical forces acting on the support means when the coefficient of friction between the support means and the frame is at least 0.3 such that the friction force between the support means and the frame is less than the weight of the bin together with any copy sheets thereon and means to sequentially vertically move said bins in said frame past a sheet entrance position.

2. The sorter according to claim 1, wherein said at least two support means comprise substantially vertical legs attached to said sheet stacking bed with feet attached at the end and slidingly engagable with said frame member, said feet being vertically spaced apart.

3. The sorter according to claim 2, wherein said plural support means comprises three vertical legs attached to said sheet stacking bed with feet attached at the end and slidingly engagable with said frame member, at least one of said feet being below the sheet stacking bed and the remaining feet being above the sheet stacking bed.

4. The sorter of claim 2, wherein said frame member is a vertical planar member portions of which are substantially vertically slidingly engagable with the feet of said bin legs.

5. The sorter of claim 4, wherein said planar member portions comprise substantially vertical slots in said planar member for sliding engagement with said feet.

6. The sorter of claim 1, wherein said means to move said bins in said frame includes means to vertically bidirectionally move said bins past said sheet entrance position.

7. The sorter of claim 6, wherein said means to move said bins comprises at least one rotatably mounted cam having at least one notch in the peripheral surface thereof adapted to engage the feet of successive bins to move the bins from one side of the sheet entrance position to the other.

8. The sorter of claim 7, including means to resiliently urge the feet of successive bins into engagement with the peripheral surface of said cam.

9. The sorter of claim 8, wherein said means to urge comprises at least one spring connected to the lowermost bin of said plurality of bins to bias the uppermost bin of said plurality of bins located below said cam upwardly into engagement with the peripheral surface of said cam.

10. The sorter of claim 8, wherein said feet on the lowermost bin are of a unique shape such that engagement with said cam is prevented.

11. The sorter of claim 3, wherein said legs are inclined at a small angle from vertical to enable them to nest one on the other.

12. A printing system including means for producing fixed toner images on copy sheets, sorter means positioned to receive the copy sheets from said producing means at an inlet region for sorting the copy sheets into sets of documents said sorter comprising a plurality of vertically nestable movable bins, a frame member for supporting said bins adjacent only one edge of said bins, said bins being supported in said frame in cantileversed fashion only about one edge and being open and unsupported at any other edge;

each bin comprising a sheet stacking bed together with plural means to movably support and frictionally slide the bin in said frame, said plural means comprising at least two support means slidingly engagable with said frame and sufficiently vertically spaced apart to prevent static equilibrium of vertical forces acting on the support means when the coefficient of friction between the support means and the frame is at least 0.3 such that the friction force between the support means and the frame is less than the weight of the bin together with any copy sheets thereon and means to sequentially vertically move said bins in said frame past a sheet entrance position.

13. The printing system according to claim 12, wherein said at least two support means comprise substantially vertical legs attached to said sheet stacking bed with feet attached at the end and slidingly engagable with said frame member, said feet being vertically spaced apart.

14. The printing system according to claim 13, wherein said plural support means comprises three vertical legs attached to said sheet stacking bed with feet attached at the end and slidingly engagable with said frame member, at least one of said feet being below the sheet stacking bed and the remaining feet being above the sheet stacking bed.

15. The printing system according to claim 13, wherein said frame member is a vertical planar member portions of which are substantially vertically slidingly engagable with the feet of said bin legs.

16. The printing system according to claim 15, wherein said planar member portions comprise substantially vertical slots in said planar member for sliding engagement with said feet.

17. The printing system according to claim 12, wherein said means to move said bins in said frame includes means to vertically bidirectionally move said bins past said sheet entrance position.

18. The printing system according to claim 17, wherein said means to move said bins comprises at least one rotatably mounted cam having at least one notch in the peripheral surface thereof adapted to engage the feet of successive bins to move the bins from one side of the sheet entrance position to the other.

19. The printing system according to claim 18, including means to resiliently urge the feet of successive bins into engagement with the peripheral surface of said cam.

20. The printing system according to claim 19, wherein said means to urge comprises at least one spring connected to the lowermost bin of said plurality of bins to bias the uppermost bin of said plurality of bins located below said cam upwardly into engagement with the peripheral surface of said cam.

21. The printing system according to claim 19, wherein said feet on the lowermost bin are of a unique shape such that engagement with said cam is prevented.

22. The printing system according to claim 14, wherein said legs are inclined at a small angle from vertical to enable them to nest one on the other.

* * * * *